US005318307A

United States Patent [19]

Bouchard et al.

[11] Patent Number: 5,318,307

[45] Date of Patent: Jun. 7, 1994

[54] SUPER TIR-TAC-POC TOSSING GAME

[76] Inventors: Marcel Bouchard, 269 St-Jean-Baptiste, St-Henri de Lévis, Quebec G0R 3E0; Raymond Fortin, 259 de la Brunante, Beauport Quebec G1C 6R2, both of Canada

[21] Appl. No.: 48,238

[22] Filed: Apr. 19, 1993

[30] Foreign Application Priority Data

Dec. 18, 1992 [CA] Canada ..... 2,085,764

[51] Int. Cl.[5] ..... A63B 67/06

[52] U.S. Cl. ..... 273/346; 273/271; 273/350; 273/399; 273/400; 273/402; 273/424; 273/DIG. 30

[58] Field of Search ..... 273/346, 271, 336, 337, 273/338, 398, 399, 400, 401, 402, 424, 428, 350, DIG. 30

[56] References Cited

U.S. PATENT DOCUMENTS

| | | | |
|---|---|---|---|
| 1,279,654 | 9/1918 | Charlesworth | 273/399 |
| 1,540,230 | 6/1925 | Schror et al. | 273/271 |
| 1,573,711 | 2/1926 | Houle | 273/337 |
| 3,107,095 | 10/1963 | Cairns | 273/398 |
| 3,749,401 | 7/1973 | Hayko | 273/400 X |
| 3,895,801 | 7/1975 | Baird | 273/350 |
| 4,395,046 | 7/1983 | Cosmopulos | 273/424 |
| 4,553,738 | 11/1985 | Zehr | 273/424 |
| 4,736,955 | 4/1988 | Pollock | 273/236 X |
| 4,936,590 | 6/1990 | Palmer | 273/402 |
| 4,940,441 | 7/1990 | Novinsky | 273/424 X |
| 5,110,139 | 5/1992 | Baumgartner | 273/400 |
| 5,123,651 | 6/1992 | Green | 273/400 |

*Primary Examiner*—William H. Grieb

[57] ABSTRACT

A game of skill and strategy that can be played on almost any surfaces (grass, sand, water, cement, etc.), indoors as well as outdoors. This game shows some resemblance with "tic-tac-toe". The game comprises a reception frame divided into nine squares and four groups of disks, two for each player. The squares from targets to be hit with the disks. The first set of disks is made up of at least nine disks of the same diameter, density and thickness. The second set has only three disks of a larger diameter than those of the first group. The larger size of the disks of the second set makes them harder to lodge in the target squares. This is compensated by the fact that a larger disk can remove one of the opponent's disks and take possession of the square. First, the players take turns trying to toss the small disk into the squares. After this phase, they use the larger disks to try to dislodge the opposing player's disks and gain an advantage on him.

13 Claims, 11 Drawing Sheets

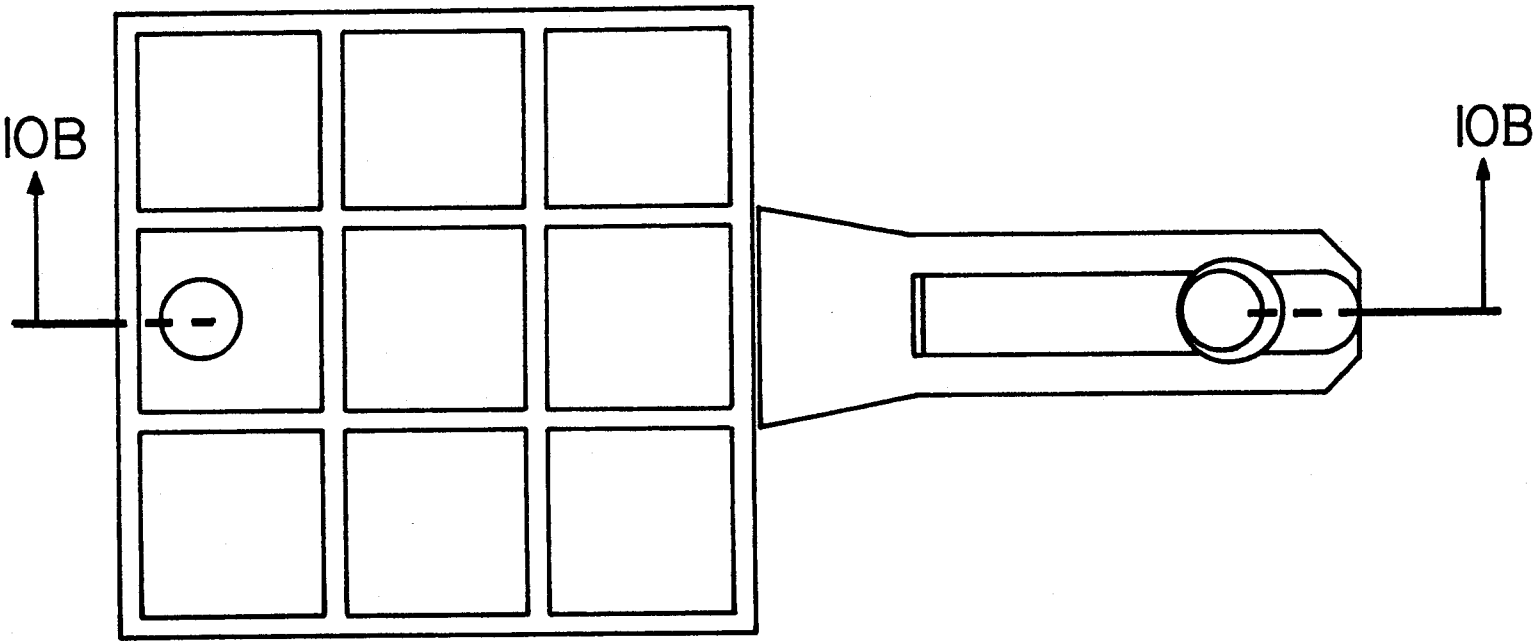
FIG. IOA
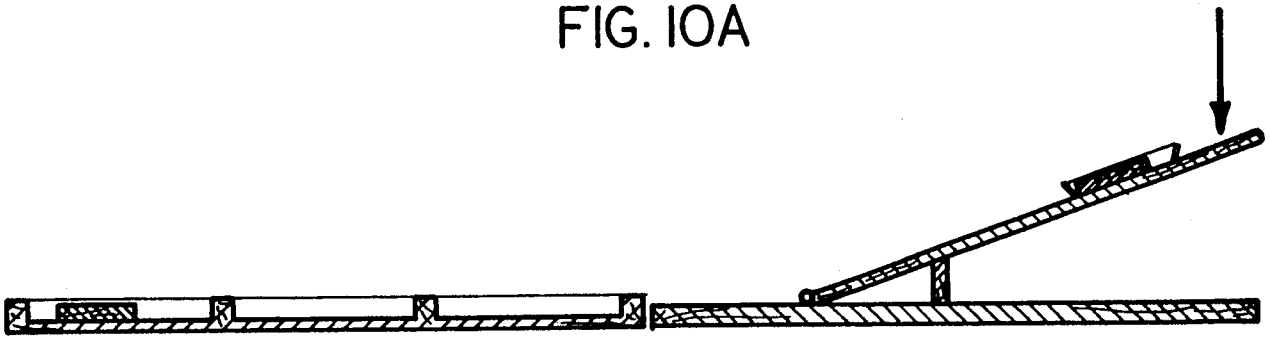
FIG. IOB

SUPER TIR-TAC-POC TOSSING GAME

BACKGROUND OF THE INVENTION

1. Field of the Invention

This invention relates to pitch games utilizing disk-type throwing devices and a frame designed to receive the disks.

2. Description of the Prior Art

A past art patent search was conducted and a list of patents which appeared to us to be most pertinent to the invention follows.

NL 7,415,769, Reunders concerns a game using balls that are thrown onto a flat board divided into nine zones. These zones are identified by letters (A, B, C) and numbers (1, 2, 3). Each zone is pierced at its center with a hole to receive the balls.

U.S. Pat. No. 5,123,656 Jun. 23, 1992, Green represents a target made of vertical receptacles, internal and external. This target may receive many kinds of small projectiles.

U.S. Pat. No. 5,110,139, May 5, 1992, Baumgartner illustrates a game using disks that are tossed into a receptacle placed at a certain distance. The receptacle is divided into zones to which are attributed different scores.

U.S. Pat. No. 4,940,441, Jul. 10, 1992, Novinsky represents a disk-like projectile. The weight of the projectile can be modified by removing the central part of the disk.

U.S. Pat. No. 4,936,590, Jun. 26, 1990, Palmer describes a pitch game utilizing disk-type throwing devices and a standing platform designed to catch and retain the disks.

U.S. Pat. No. 4,553,758, Nov. 19, 1985, Zehr refers to a disk that can bounce on water a great number of times.

U.S. Pat. No. 4,395,046, Jul. 26, 1983, Cosmopoulos illustrates a disk designed to bounce on water.

CN 2,0927,388 is a game made up of fork-like pickets and ring projectiles.

CN 1,181,446 uses the principle of tick-tack-toe*. Projectiles made of little sacks filled with loose material are tossed onto a receptacle frame that can be magnetic.

*corresponds to Webster's tick-tack-toe or tit-tat-toe

A tick-tack-toe game available in stores is made of a frame holding nine rectangular tilting targets. Upon the impact of a projectile, the target rotates and displays an "X" or an "O".

SUMMARY OF THE INVENTION

The goal is to design a game of skill, strategy and competition that can be played by two players on almost any surfaces (grass, sand, water, cement, etc.), indoors as well as outdoors, and that uses some elements of tick-tack-toe (these being the vertical, horizontal and diagonal lines that indicate a success). The game is made up of a square reception frame divided into nine squares and two kinds of disks each divided in two sets. Each player receives a set of each kind. The first type of disk is much smaller than the squares of the frame and is usually easy to toss into a square. The second type of disks is of a size approaching the dimension of a square, which makes it much harder to toss into the target square. The increased difficulty of placing a larger disk in a square is rewarded by the fact that the player can remove his adversary's disk in that square if he succeeds his throw.

Our invention uses sets of disks of various dimensions destined to be tossed onto horizontally placed reception frame and not to be thrown as flying disks.

The uniqueness of our invention lies in the fact that it adds the skills and precision of a tossing game to the tactics of tick-tack-toe, made more complex by the presence and capabilities of the larger disks. As opposed to conventional tick-tack-toe the game cannot end unless there is a winner. More over, the design of our invention can be adapted for use on water.

A more particular overall objective is to provide a tossing game in which two players take turns tossing pieces that identify each player; the game comprising a square reception frame divided into nine square zones of identical size, and playing pieces to be tossed into the zones; the playing pieces of each player being divided in two categories: the first category formed of pieces of small diameter relatively easy to lodge in a square zone; the second being made up of large diameter pieces more difficult to lodge in the square zone and thus having the ability to remove the other pieces; the tossing of the pieces in the zones permitting to complete vertical, horizontal or diagonal lines or to occupy by at least one piece of a player's the four corner zones. In the tossing game the size of the pieces is to permit to fit at least nine (9) small pieces in a square zone and at the most five (5) large pieces in a square zone and the borders between the square zones are to be twice the thickness of the disks.

BRIEF DESCRIPTION OF THE DRAWINGS

FIG. 10A illustrates a top view of a table top mode with a launching system for downsized disks.

FIG. 10B is a cut according to line 10 B of FIG. 10A.

With reference to FIG. 1, we can see a preferred reception frame 10 used as a target. The frame is square and divided by borders 12 into 9 identical square zones 14 laid out in three rows of three squares each: that is a lower row 16, a middle row 18, a top row 20.

Figure 1:
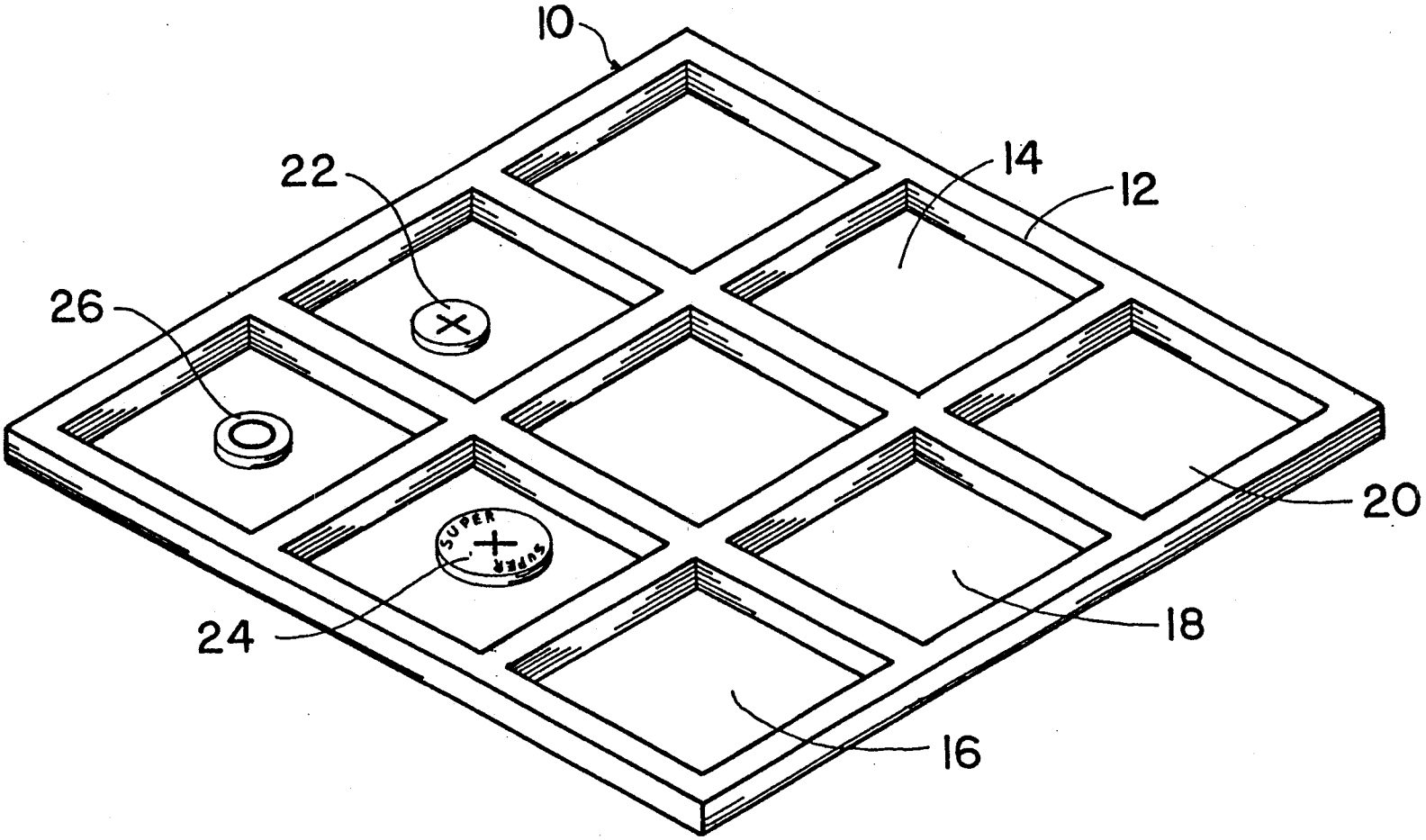
FIG. 1 shows a perspective view of the reception frame.
Figure 3C:
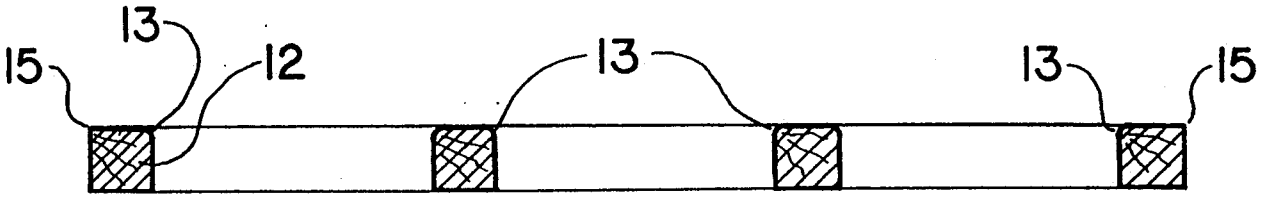
FIG. 3C shows a cross-sectional view along line 3C—3C of FIG. 3

In that configuration the borders have rounded top edges as seen in FIG. 3C. The border's sides have a small thickness relative to the length of a square's edge 14. The edges of the squares have a length of about 12 inches and the borders FIG. 3C a width and height of 1½ inch. The radius of the rounded edges is of about ⅝ of an inch. The outer top edges of the frame remain at a right angle.

Figure 4A:
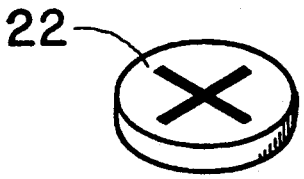
FIGS. 4A and 4B illustrate perspective views of the two disks of FIG. 2.
Figure 4B:
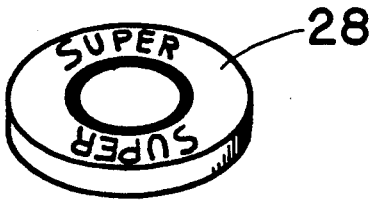
Figure 4C:
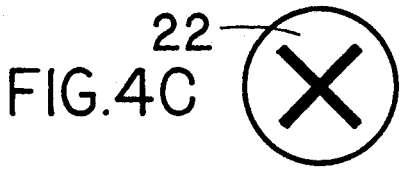
FIGS. 4C–4F show top views of disks of FIG. 4A and of FIG. 1.
Figure 4D:
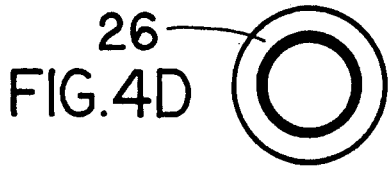
Figure 4E:
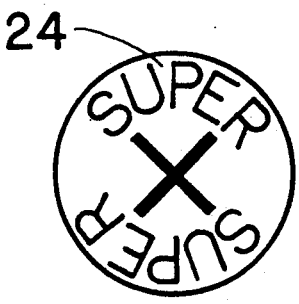
Figure 4F:
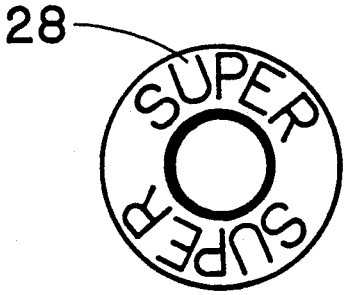
Figure 4G:
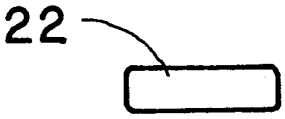
FIG. 4G–4H are front views of the disks of FIG. 4A and FIG. 4B.
Figure 4H:
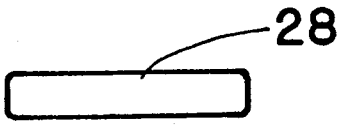

As seen on FIG. 4B, the game includes eleven small disks 22 and three larger disks 24 marked with an "X" and also eleven small disks 26 and 3 large ones 28 marked with an "O". The diameter of the small disks 22 and 26 is about one third of a square's interior length. The width and height of the borders 12 is about twice the thickness of the disks 22, 24, 26, 28.

The small disks 22 and 26 have a diameter around 4 inches and a thickness of about ¾ of an inch. The large disks 24 and 28 have a diameter of about 5 inches and a thickness of about ¾ of an inch. The diameter of the large disks 24 and 28 are 40 to 60% shorter than the side of the nine square zones. This makes the area of the large disks 25% of the area of a square zone.

For the small and large disks, the dimension, material used and its rigidity, colour, and the marks "O" and "X" are not limitative factors of the construction. The small disks number at 11 per player, that is one per square zone and two spares. There is three large disks per player, one for each row.

Figure 5:
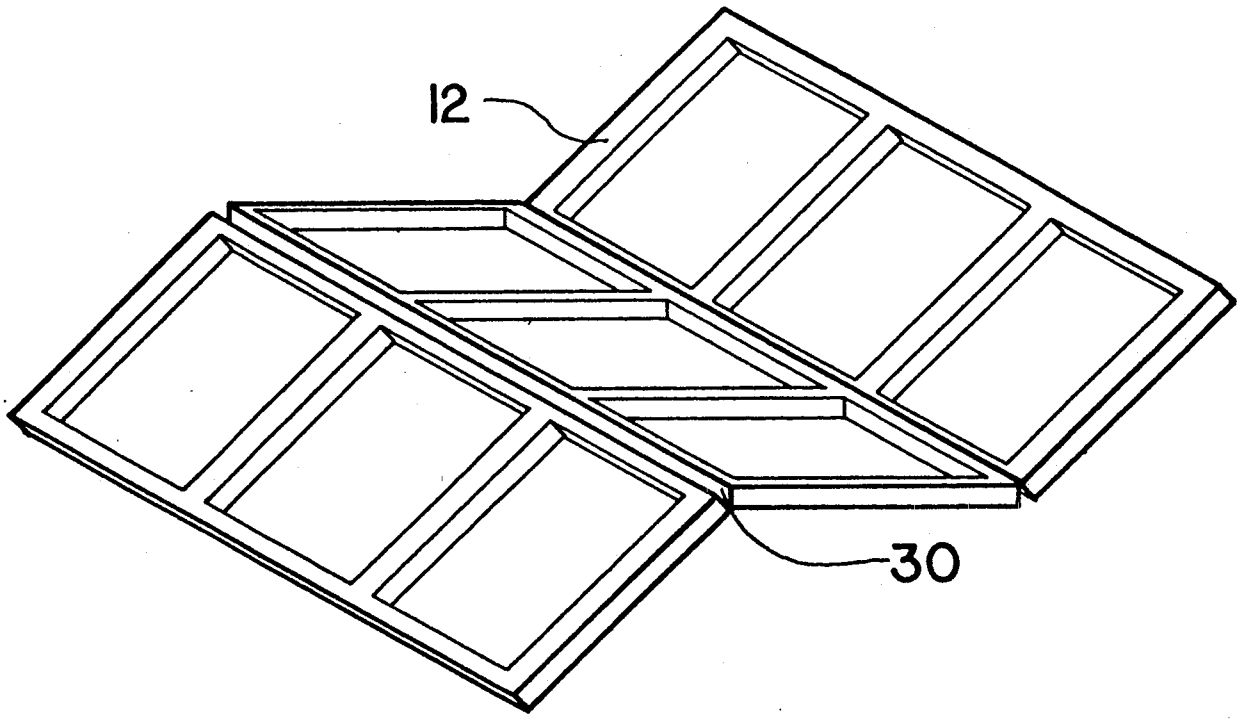
FIG. 5 shows a perspective view of a folding reception frame, an alternative to FIG. 1.

Moreover the reception frame can be fashioned into a folding unit as seen on FIG. 5. The dimensions, position (horizontal or vertical) and rigidity of the material used are not limitative factors in the construction of the frame.

Since the borders have twice the thickness of the disks, two disks can fall atop one another inside a square zone without bouncing offside too easily. The borders can be made foldable—FIG. 5—with the use of a hinge 30. In that case, the borders are preferably rigid.

Figure 6:
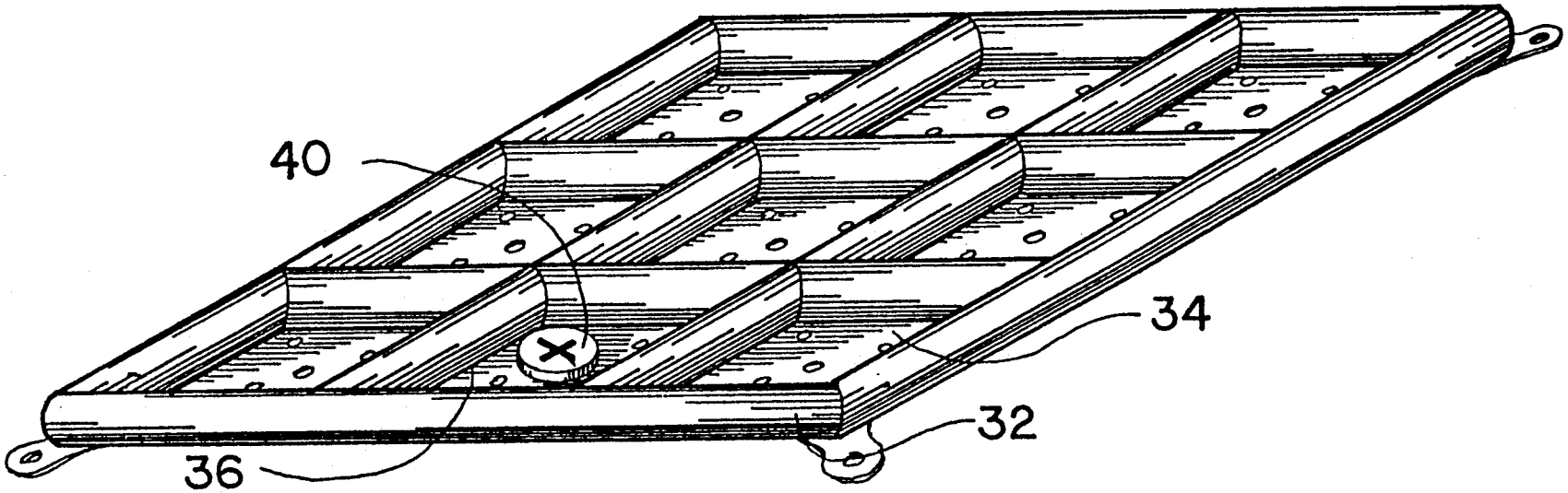
FIG. 6 is another alternative showing an inflatable reception frame.
Figure 7A:
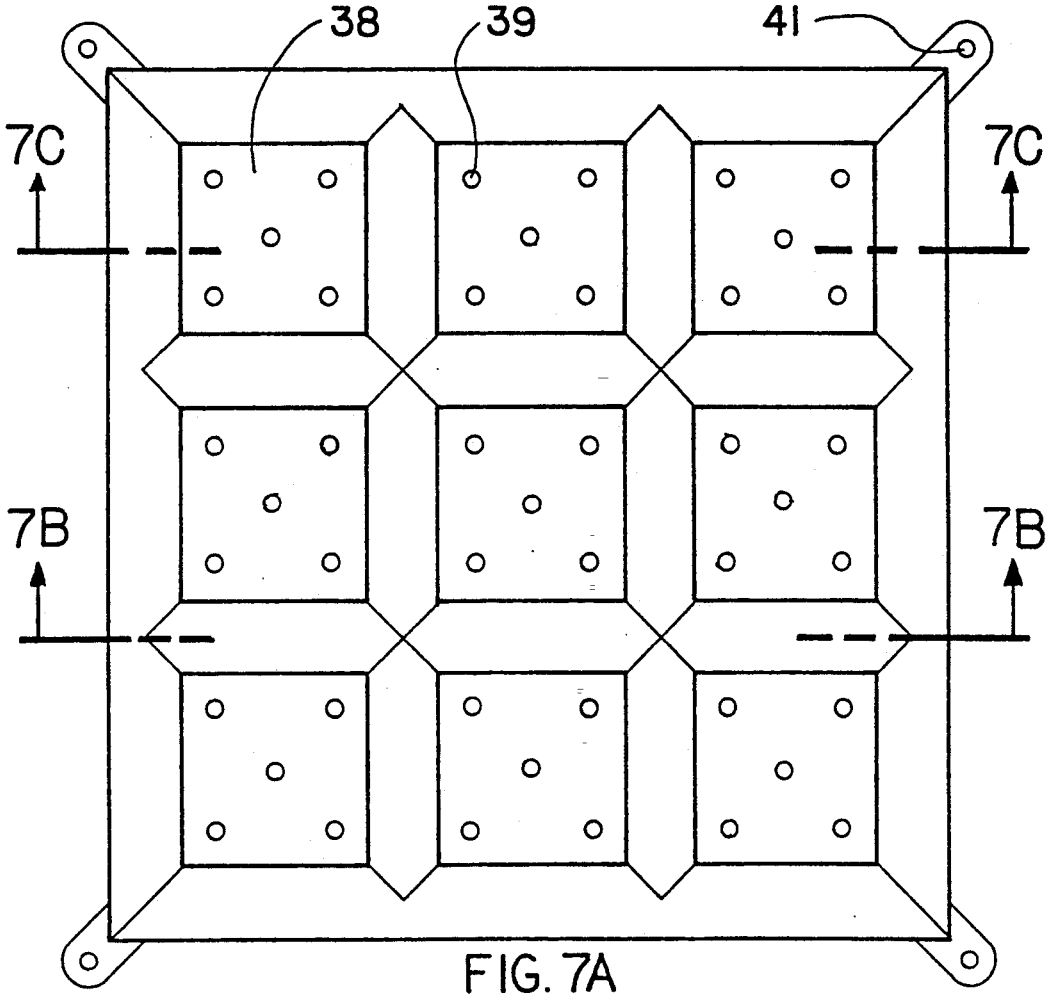
FIG. 7A is a top view of the inflatable frame of FIG. 6.
Figure 7B:
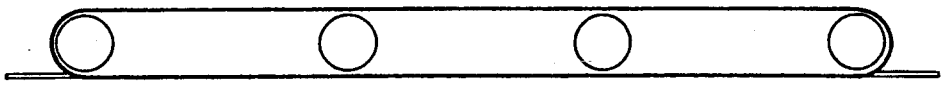
FIG. 7B is a cross-sectional view along line 7B—7B of FIG. 7A.
Figure 7C:
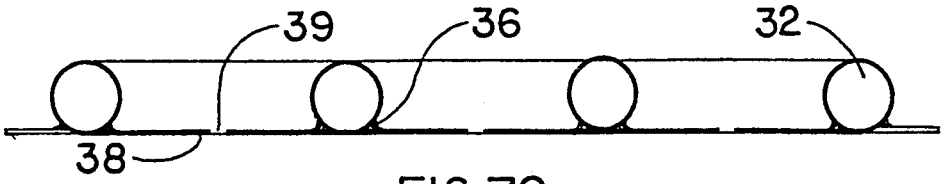
FIG. 7C is a cross-sectional view along line 7C—7C of FIG. 7A.

In another configuration—FIG. 6—the target zones comprise borders made of inflatable material and may comprise a flat bottom attached to said borders to retain said projectiles and further including means for water circulation. Further more, means for water circulation comprise openings in said flat bottom. In this embodiment the borders 32 are made of inflatable material. The bottom of the square zones 34 is flat and attached by an adhesive 36 to the inflatable borders, as seen on FIG. 7. Thus the structure can retain the projectiles 40. It should be noted that this bottom is not water-tight and is pierced with apertures or openings 39 to let water flow through. Attaching points are provided to anchor the game in water.

Figure 8A:
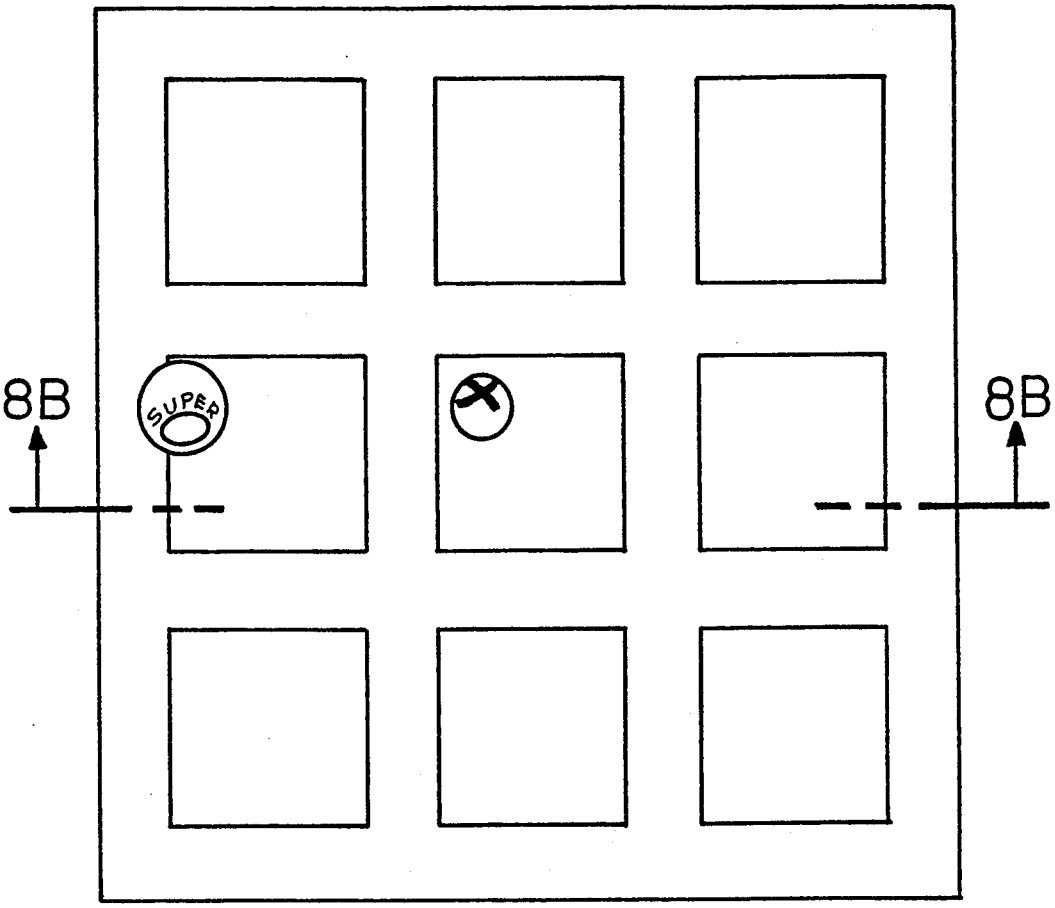
FIG. 8A is another alternative frame using VELCRO.
Figure 8B:
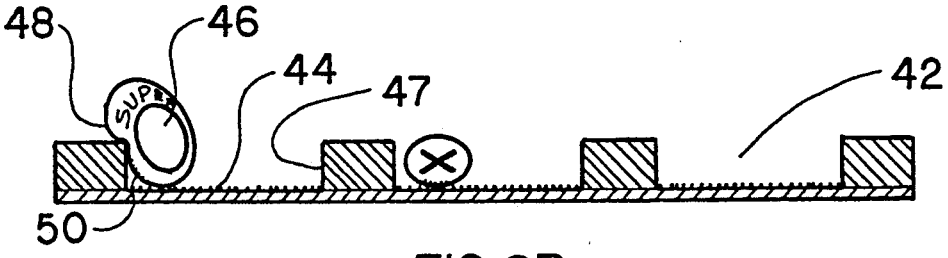
FIG. 8B shows a cross-section of the reception frame of FIG. 8A.
Figure 9:
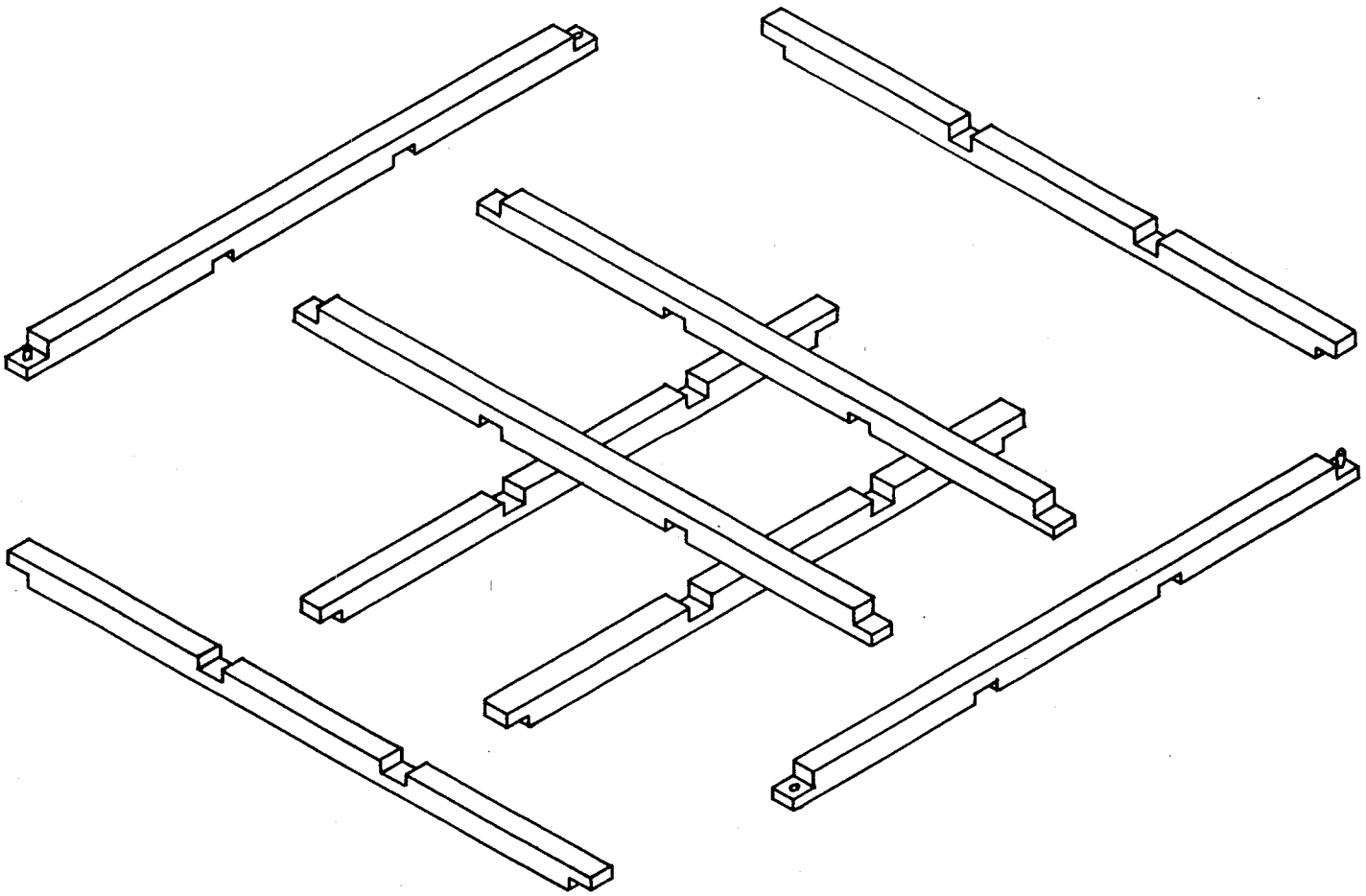
FIG. 9 shows an exploded view of the a reception frame assembly.
Figure 11B:
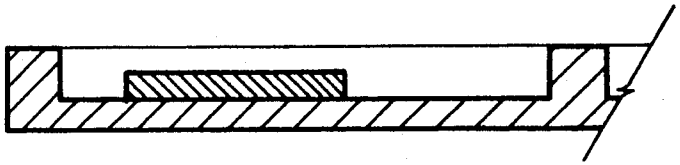
FIG. 11B is a cut view according to line 11B—11B of FIG. 11A.
Figure 11C:
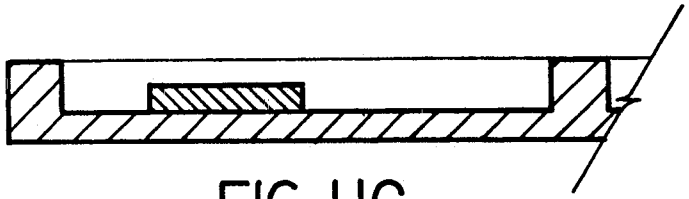
FIG. 11C is a cut view according to line 11C—11C of FIG. 11A.
Figure 11A:
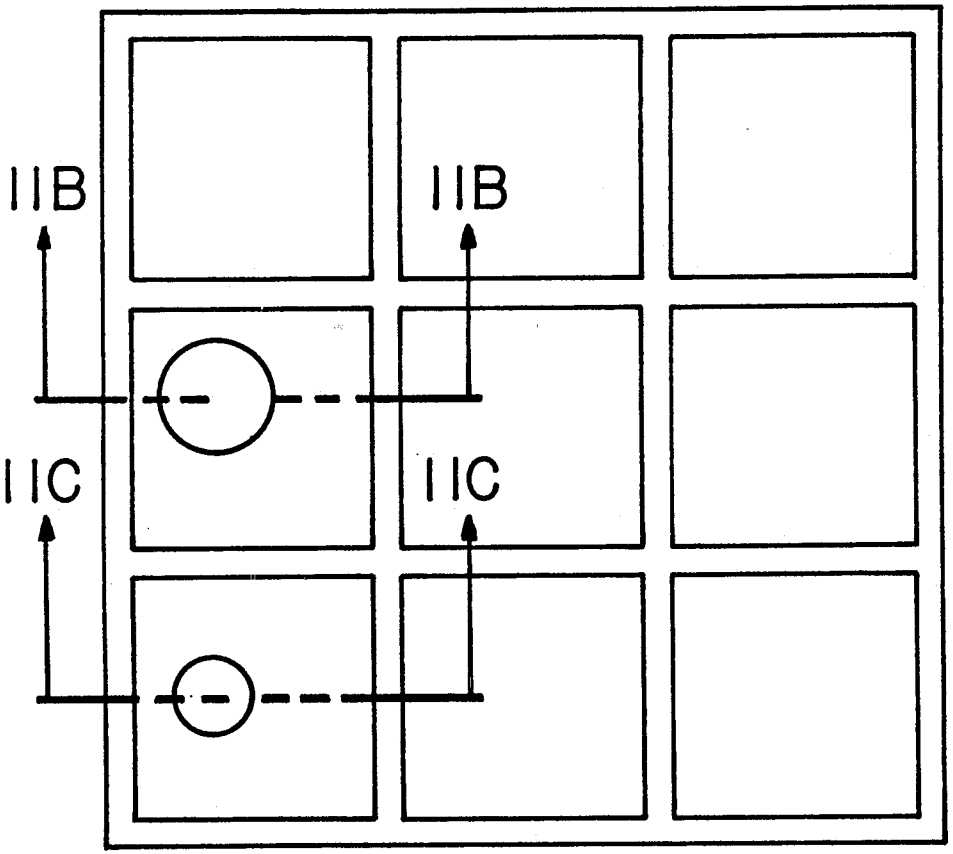
FIG. 11A is a top view of table model frame.

In the case of a configuration using VELCRO—FIG. 8—, the disk projectiles would have a tendency to stick to the border. To compensate, the borders 47 are made sensibly higher.

Another variant is a smaller tabletop version of the game—FIG. 10—. It uses the same rules as the official game and has also the same general proportions. The major difference lies in the use of a small springboard to propel the downsized disks in the air towards the reception frame. The spring forms a catapult and is preferably set at eleven (11) inches from any border also of 11 inches.

The reception frame and disks in any configuration can be fluorescent or phosphorescent. We have observed that the use of a phosphorescent frame and playing pieces creates a lack of perspective. The difference in difficulty between tossing the small and large disks in the square zones is thus augmented. The contrast between the phosphorescent borders and the dark squares makes the target zones appear twice smaller. The chance to hit a target square with a small disk is reduced by 35%. With a large disk, the probability is reduced by 50%. The overall difficulty of the game is augmented by 25% when played in the evening.

RULES OF THE GAME

The game is played by two players or by teams of two, for a total of four (4) players. The beginning player or team is chosen at random, heads or tail. The adversaries take turns tossing the disks in one of the nine zones of the reception frame.

The goal is to line horizontally, vertically or diagonally, three disks of a same set (ex.: "X") to realize a "tick-tack-toe". The large disks have the ability to remove an adversary's small or large disk. When a player succeeds in a "Tick-tack-toe", his opponent has only one chance to block him. If he succeeds, the game goes on; otherwise the game is over.

A success is also achieved if four disks of a same player occupy the four corners of the reception frame. The distance between the players and the reception frame is left at the discretion of the opponents. The recommended distance is 12 feet, for the standard model game, or generally twelve (12) times the length of side of the square.

As a variation of the subject invention a point system may be installed with the same mechanical system and because of the combination of the two sizes of disks, namely permitting a cumulation of points resulting from the strategic utilization of the superior disk: for example a single line completed with the small disk corresponds to five (5 ) points; the same line completed with a superior disk yields ten (10) points; a double line (two Tick-tack-toe at the same time) yields twenty (20) points. The players may chose to use the superior disk in the attacking phase instead of strictly defensively, which accentuates the complexity of the game, given the restricted number of superior disks. In this manner the game may last a longer time and create champions.

Other variations are possible and limited only/by the scope of the appended claims:

We claim:

1. A tossing game in which two players take turns tossing pieces that identify each player;

said game being comprised of a square reception frame divided into nine square zones of identical size and of playing pieces to be tossed into said zones;

the playing pieces of each player being divided in two categories: the first category formed of pieces of a first size; the second being made up of pieces of a second size, larger than the first size, said second size pieces being harder to lodge in the square zones, said second size pieces being less numerous than the first size pieces and having, by definition of the rules, the ability to remove any other pieces already lodged in the targeted square zone;

the tossing of the pieces in said zones permitting to complete vertical, horizontal or diagonal lines or to occupy by at least one piece of a player's the four corner zones.

2. A game as described in claim 1 wherein said ability to remove pieces is carried out by the players themselves.

3. A game as described in claim 1 wherein the pieces assigned to each player are identified by two (2) different symbols.

4. A game as described in claim 1 wherein there are nine (9) to twelve (12) first type pieces per player and three (3) second type pieces per player.

5. A game as described in claim 1 wherein the playing pieces of each player comprise two categories: the first category formed of disk like pieces of a first size; the second being made up of disk like pieces of a second size larger than the first size.

6. A game as described in claim 5 wherein the size of the pieces permits to fit at least nine (9) small pieces in a square bottom zone and at the most five (5) large pieces in the same or equivalent square zone.

7. A game as described in claim 5 wherein the pieces are disks of first and second size, said first size pieces being of at least the same thickness as the first size pieces.

8. A game as described in claim 7 wherein said disks of the second size are 50% thicker than said disks of the first size.

9. A game as described in claim 5 wherein said square zones comprise borders of twice the thickness of said first size disks.

10. A game as described in claim 1 wherein said zones comprise borders made of inflatable material.

11. A game as described in claim 10 wherein said borders comprise a flat bottom attached to said borders to retain said projectiles and further including means for water circulation through said bottom.

12. A game as described in claim 11 wherein means for water circulation comprise openings in said flat bottom.

13. A tossing game in which two players take turns tossing pieces that identify each player;

said game being comprised of a Square reception frame divided into the nine square zones of identical areas and of playing pieces to be tossed into said zones;

the playing pieces of each player being divided in two categories: the first category formed of pieces of a first type of projectile; the second category being made up of second type of projectile harder to lodge in the square zones, said second type being less numerous than the first category and having, by definition of the rules, the ability to remove any other projectiles already lodged in the targeted square zone;

the tossing of the projectiles in said zones permitting to complete vertical, horizontal or diagonal lines or to occupy by at least one piece of a player's the four corner zones.

* * * * *

UNITED STATES PATENT AND TRADEMARK OFFICE

CERTIFICATE OF CORRECTION

PATENT NO. : 5,318,307

DATED : June 7, 1994

INVENTOR(S) : Marcel Bouchard et al

Figure 3B:
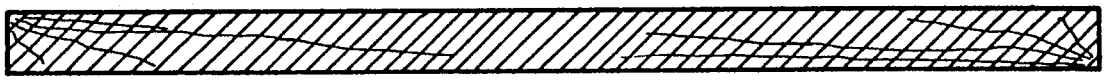
FIG. 3B shows a cross-sectional view along line 3B—3B of FIG. 2.
Figure 3A:
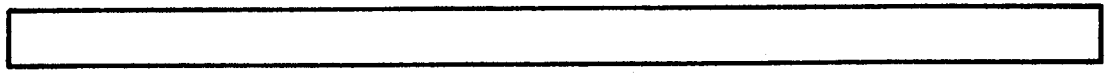
FIG. 3A is a front view according to line 3A—3A of FIG. 2.
Figure 3C:
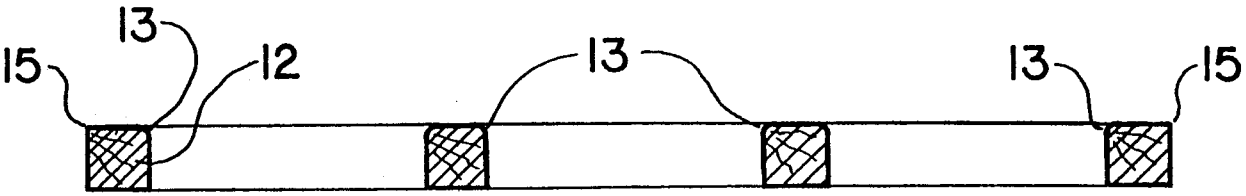
Figure 3B:
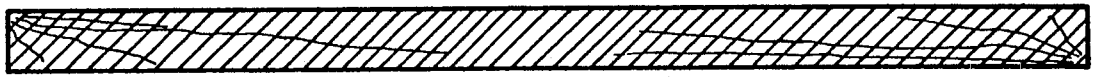
Figure 3A:
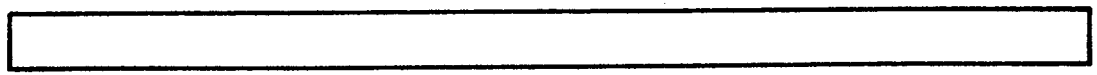
Figure 2:
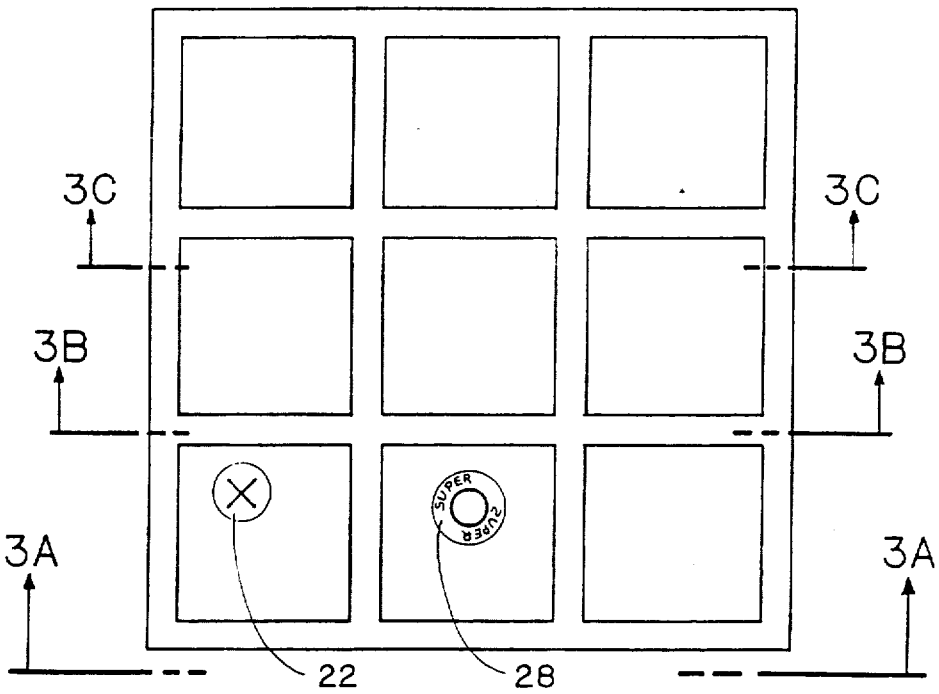
FIG. 2 is a top view of the reception frame and two disks.

It is certified that error appears in the above-indentified patent and that said Letters Patent is hereby corrected as shown below:

In the drawings --Insert Fig. 2 on page 2 of 11-- and
delete --Figs. 3A, 3B and 3C on page 2 of 11--

Signed and Sealed this

Thirteenth Day of September, 1994

*Attest:*

*Attesting Officer*

Bruce Lehman

BRUCE LEHMAN

*Commissioner of Patents and Trademarks*